US007819400B2

(12) United States Patent
Miyoshii et al.

(10) Patent No.: US 7,819,400 B2
(45) Date of Patent: Oct. 26, 2010

(54) SHEET FEEDING APPARATUS, AND DOCUMENT FEEDING APPARATUS AND IMAGE PROCESSING APPARATUS INCLUDING THE SAME

(75) Inventors: Fuminori Miyoshii, Nara (JP); Hidetoshi Atsumi, Nara (JP); Junko Yabuta, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 246 days.

(21) Appl. No.: 11/845,947

(22) Filed: Aug. 28, 2007

(65) Prior Publication Data

US 2008/0106027 A1 May 8, 2008

(30) Foreign Application Priority Data

Sep. 1, 2006 (JP) ..... 2006-237992

(51) Int. Cl.
*B65H 7/02* (2006.01)

(52) U.S. Cl. ..... 271/265.04; 271/262; 271/263

(58) Field of Classification Search ..... 271/262, 271/263, 265.04, 266
See application file for complete search history.

(56) References Cited

U.S. PATENT DOCUMENTS

| | | | | |
|---|---|---|---|---|
| 7,445,209 | B2 | 11/2008 | Sano et al. | |
| 2004/0070142 | A1* | 4/2004 | Kawasaki | 271/262 |
| 2005/0012259 | A1* | 1/2005 | Sano et al. | 271/10.01 |
| 2005/0127597 | A1* | 6/2005 | Sano et al. | 271/258.01 |
| 2005/0269759 | A1* | 12/2005 | Sano et al. | 271/3.01 |

FOREIGN PATENT DOCUMENTS

| | | |
|---|---|---|
| CN | 1625208 | 6/2005 |
| JP | 60-178141 | 9/1985 |
| JP | 04-197946 | 7/1992 |
| JP | 09-235033 | 9/1997 |
| JP | 2006-188354 | 7/2006 |

* cited by examiner

*Primary Examiner*—Stefanos Karmis
*Assistant Examiner*—Ernesto Suarez
(74) *Attorney, Agent, or Firm*—Renner, Otto, Boisselle & Sklar, LLP

(57) ABSTRACT

The present invention provides a sheet feeding apparatus including an overlapped feeding detection apparatus which can securely detect overlapped feeding as to a sheet being fed, and a document feeding apparatus and an image processing apparatus including the sheet feeding apparatus. A paper feeding apparatus 1*b* includes a paper feed tray 11, a pickup roller 61, a paper roller 63, a sorting roller 64, feeding rollers 66*a*, resist rollers 67, a paper ejection roller 73, a passage detection sensor 69, an overlapped feeding detection sensor 68 and a second detection apparatus 71. Recording paper is delivered from the paper feed tray 11 by the pickup roller 61 according to a printing instruction from a user. The recording paper is fed to the resist rollers 67 through the paper roller 63, the sorting roller 64, the feeding rollers 66*a* and the passage detection sensor 69. The recording paper temporarily stops at the resist rollers 67. In this case, the overlapped feeding detection sensor 68 detects overlapped feeding of the recording paper.

14 Claims, 8 Drawing Sheets

SHEET FEEDING APPARATUS, AND DOCUMENT FEEDING APPARATUS AND IMAGE PROCESSING APPARATUS INCLUDING THE SAME

BACKGROUND OF THE INVENTION

1. Field of the Invention

The present invention relates to a sheet feeding apparatus for feeding sheets in various image processing apparatuses, such as a printer, a copier and a document reading apparatus.

2. Description of the Related Art

In general, a sheet feeding apparatus includes a document feeding apparatus for feeding a document having information recorded therein placed on a document tray to a document mount (contact glass) for reading image information and a paper feeding apparatus for feeding it to a printing portion for printing read image information on recording paper. These apparatuses feed a bundle of documents or paper sheet by sheet to the document mount or the printing portion.

When feeding a sheet such as the document or the recording paper, there are the cases where multiple sheets are overlappingly fed due to static electricity, humidity or the like. For that reason, there is a problem that the fed sheets lag in a feeding path and a paper jam occurs.

Thus, the sheet feeding apparatus is provided with an overlapped feeding detection apparatus for detecting whether the sheets are fed one by one. For instance, in Japanese Patent Laid-Open No. 60-178141 and Japanese Patent Laid-Open No. 04-197946, transit time of the fed sheet from its anterior end to its posterior end is detected by using a sheet passage detection apparatus for detecting whether the sheet has passed a paper path, and a length of the passed sheet is determined from the detected transit time so as to determine whether there is overlapped feeding by whether the length is longer than a specified sheet length.

Japanese Patent Laid-Open No. 09-235033 provides an ultrasonic sensor for generating an ultrasonic wave from a wave transmitter and receiving the ultrasonic wave with a wave receiver, where the ultrasonic wave is applied to the sheet being fed and the ultrasonic wave having passed the sheet is received by the wave receiver so as to determine whether there is the overlapped feeding from a change in a ultrasonic signal volume received.

In the cases of Japanese Patent Laid-Open No. 60-178141 and Japanese Patent Laid-Open No. 04-197946, it is determined whether there is the overlapped feeding from the length of the sheet having passed the paper path. Therefore, the overlapped feeding cannot be detected in the case where the feeding is performed with the sheets overlapping due to static electricity or the like, that is, in an overlapping state with no displacement between the sheets.

In the case of Japanese Patent Laid-Open No. 09-235033, it is determined whether there is the overlapped feeding by applying the ultrasonic wave to the sheet being fed, that is, a moving sheet. For that reason, an ultrasonic signal received on the wave receiver side fluctuates due to undulation of the sheet or the like so that the overlapped feeding cannot be accurately detected.

Thus, in view of the problems, an object of the present invention is to provide a sheet feeding apparatus including an overlapped feeding detection apparatus which can securely detect the overlapped feeding as to the sheet being fed, and a document feeding apparatus and an image processing apparatus including the sheet feeding apparatus.

SUMMARY OF THE INVENTION

To attain the object, the present invention provides a sheet feeding apparatus for feeding sheets one by one, comprising an overlapped feeding detection apparatus for stopping sheets being fed and detecting mutual overlapping of the sheets.

The overlapped feeding detection apparatus includes a noncontact type sensor for performing detection by applying an ultrasonic wave, a laser or the like to the sheet flowing in a paper path and a contact type sensor for performing detection by applying a limit switch, an electrode or the like. In the cases where the overlapped feeding detection apparatus is the noncontact type sensor, if a target sheet undulates, that undulation becomes noise and deteriorates detection accuracy. Thus, the present invention stops the sheet and then detects whether there is the overlapped feeding.

In the cases where the overlapped feeding detection apparatus is the contact type sensor, if the target sheet undulates, the sensor does not contact it so that the overlapped feeding cannot be detected. Thus, the present invention stops the sheet and then detects whether there is the overlapped feeding.

Under ordinary circumstances, the sheet being fed is moving in the paper path and so the sheet itself undulates. For that reason, if the overlapped feeding of the sheet being fed is detected, a detection result becomes inaccurate because a detection value is not stable. Thus, the present invention once stops the sheet being fed and then detects whether there is the overlapped feeding so as not to undulate the sheet. As this prevents the sheet from undulating, the overlapped feeding detection apparatus can securely detect the overlapped feeding of the sheet being fed. The sheet includes a document on which an image is printed, recording paper for printing an image or the like.

As for a configuration of the overlapped feeding detection apparatus, it comprises: a sheet stopping portion for stopping a sheet being fed; and a detection portion for detecting mutual overlapping of the sheets as to the stopped sheets, wherein a distance from the sheet stopping portion to the detection portion is smaller than a length of a sheet in a minimum size capable of feeding.

The detection portion needs to be placed within the range of the fed sheet when the fed sheet is stopped. In the case where the detection portion is not positioned within the range of the stopped sheet, it cannot detect the overlapped feeding of the sheet. Thus, the detection portion is placed in a position where the distance from the sheet stopping portion is smaller than the length of the sheet in the minimum size capable of feeding in the sheet feeding apparatus. Thus, the detection portion can detect the overlapped feedings of all the sheets stopped by the sheet stopping portion.

The detection portion is placed in a direction orthogonal to the paper path for feeding the sheets and further upstream in a feeding direction than the sheet stopping portion. To be more precise, the detection portion is placed to be orthogonal to the paper path for feeding the sheets and further in a position capable of detecting a portion sagged when the sheet being fed is stopped by the sheet stopping portion. According to the configuration, the detection portion is positioned obliquely to the stopped sheet.

For that reason, in the case where the detection portion is the noncontact type detection portion including a transmitter and a receiver for instance, even if an output wave such as the ultrasonic wave or light outputted from the transmitter is reflected on the sheet, the reflected output wave is not reflected on the transmitter side but is horizontally diffused. To be more specific, there is no occurrence of multireflection wherein the outputted output wave is reflected on the sheet surface, reflected again on the transmitter surface, and further reflected on the sheet surface. Thus, the detection portion can prevent detection noise due to the multireflection, such as counteracting the output wave by the reflection of the output wave or erroneous reception having the output waves endlessly inputted to the receiver.

The detection portion also detects whether or not the sheets are mutually overlapping based on thickness of the sheet being fed. As for the sheets, the entire thickness is different between the case of one sheet and the case of two sheets, for instance, mutually overlapping. In reference to the thickness in the case of one sheet, it can be determined as the overlapped feeding when the detected sheet thickness is larger than the thickness in the case of one sheet.

The detection portion also comprises a wave transmitter for transmitting the ultrasonic wave and a wave receiver for receiving the ultrasonic wave. To be more specific, the detection portion is the noncontact type sensor. The detection portion can thereby detect the overlapped feeding without contacting the sheets, and so it does not generate a wrinkle or a fold on the sheets.

The detection portion starts operation after the sheet being fed stops, and detects whether or not the sheets are mutually overlapping. After the sheet stops, there is a time difference until the detection is performed. The undulation of the sheet dies down during that time, so that the sheet stands still. Thus, there will be no noise due to the undulation and sagging of the sheet interfering with a waveform of the ultrasonic wave received by the wave receiver. Therefore, the detection portion can accurately detect the overlapping of the sheets.

The detection portion constantly performs the operation while feeding the sheets, and detects whether or not the sheets are mutually overlapping when the sheets stop. Thus, the detection portion constantly generates the ultrasonic wave. For that reason, the detection portion can detect whether there is the overlapped feeding even when the sheets are passing so as to detect the overlapped feeding at an early stage. The detection portion also detects the overlapped feeding when the sheets stop. It is thereby possible to detect the overlapped feeding without missing it.

When the sheet being fed passes the detection portion, the sheet stopping portion is controlled to stop the sheet by a control apparatus. As possible methods, the sheet stopping portion stops the sheet being fed by contacting an end of the sheet with a shutter, a roller or the like, or by tightly holding the sheet being fed. To be more precise, in the case where the sheet stopping portion is the roller for instance, it is possible to utilize resist rollers for stopping the sheet being fed in order to align the ends of the sheet. The resist roller is a roller which aligns the ends of the fed sheet and feeds the sheet to an image reading portion, an optical writing unit or the like in predetermined timing. The resist roller is a conventionally provided component. Thus, it is not necessary to provide the sheet feeding apparatus with a new component in order to stop the sheet being fed.

To adjust the sheet straightly against the paper path by aligning the ends of the fed sheet, the end of the sheet is put in contact with the resist rollers and the sheet is pushed from behind the sheet. Therefore, the sheet becomes totally sagged.

Thus, the overlapped feeding detection apparatus includes a flattening portion for, on stopping the sheet being fed, flattening a part of the sheet. The flattening portion is placed further upstream in the sheet feeding direction than the sheet stopping portion and further downstream in the sheet feeding direction than the detection portion. The detection portion can thereby detect the overlapped feeding from a stopped and flattened sheet.

Here, a part of the sheet is the upstream side in the feeding direction of the sheet, that is, the posterior end side. The anterior end side of the sheet contacts the sheet stopping portion so that the entire sheet is sagged. If the entire sheet is flattened, a wrinkle, a fold or the like may be generated on the sheet. Therefore, it is possible to eliminate bad influence such as wrinkling or folding of the sheet by flattening a part of the posterior end side of the sheet.

The flattening portion can flatten the sheet in a fixed position. For that reason, a positional relation between the flat part of the sheet and the detection portion is always constant. To be more specific, the detection portion can always detect whether there is the overlapped feeding in the flat part of the sheet so that the detection accuracy is improved.

As for the flattening portion, there is a thinkable method of sandwiching the sheet being fed from both sides with a pair of members, such as rollers, bars or flat plates. To be more precise, in the case where the flattening portion is a pair of rollers for instance, it is possible to utilize feeding rollers for feeding the sheets to the sheet stopping portion. In this case, the flattening portion sandwiches the sheet from both sides, so that the sheet on the upstream side in the feeding direction from the flattening portion stands still. To be more specific, the undulation of the sheet during the feeding is suppressed by being sandwiched by the pair of rollers. Therefore, the flattening portion can flatten the posterior end side of the sheet. As the feeding rollers are utilized as the flattening portion, there is no need to provide a new component to the sheet feeding apparatus.

The sheet feeding apparatus comprises a second detection apparatus for detecting a feeding abnormality based on the length of the sheet during the feeding of the sheet, wherein the second detection apparatus is placed on the upstream side in the sheet feeding direction against the detection portion.

For instance, in the case where the distance between the end of an upper sheet and the end of a lower sheet which are overlapping is longer than the distance between the sheet stopping portion and the detection portion, the sheets are not overlapping at a location detected by the detection portion. Therefore, the detection portion cannot detect the overlapped feeding. The second detection apparatus can detect the feeding abnormality which has not been detectable by the detection portion, that is, the overlapped feeding.

The second detection apparatus detects whether or not the sheets are mutually overlapping based on the length of the sheet being fed. For more details, the second detection apparatus times the time required for passage of the anterior end to the posterior end of the sheet flowing through the paper path. And it calculates the length of the recording paper from the timed time and feeding speed so as to detect it as the overlapped feeding when a calculation result is longer than the specified length of the sheet.

The second detection apparatus may also determine it as the feeding abnormality when the sheet of a predetermined or more length is detected from the length of the sheet being fed. Here, the predetermined length is the length which is set to be detected by the second detection apparatus as a larger length than the length of the sheet being fed in order to prevent undetected time due to on/off operation.

To be more precise, when the sheet length defined correspondingly to each sheet is $L_0$, the second detection apparatus determines it as the feeding abnormality if a length L detected by the second detection apparatus satisfies $L>L_0+L_2$. However, $L_2$ is $L_1+L\alpha>L_2$ when the distance between the sheet stopping portion and the detection portion is $L_1$. In the case where the sheet being fed has a sagging length which is $L\alpha$, $L_2$ is $L_1+L\alpha>L_2$.

According to the configuration, the second detection apparatus calculates time t0 required for passage of the anterior end to the posterior end of the sheet flowing through the paper path, that is, the sheet length L0 defined as to each sheet and time t2 calculated from the length L2 defined for the sake of preventing a detection error due to the on/off operation of the sensor. The second detection apparatus times time t required for passage of the anterior end to the posterior end of the sheet flowing through the paper path. In the case of $t>t0+t2$ where the timed time t is longer than the calculated time $t0+t2$, it is detected as the overlapped feeding. In the case of $t\leqq t0+t2$ where the timed time t is shorter, it is detected not to be the overlapped feeding.

Thus, the detection portion and the second detection apparatus can detect the sheet feeding abnormality, i.e. the overlapped feeding, irrespective of the distance between the end of the upper sheet and the end of the lower sheet.

The present invention includes the overlapped feeding detection apparatus for stopping the sheets being fed and detecting mutual overlapping of the sheets and the second detection apparatus for detecting the mutual overlapping of the sheets being fed. The overlapped feeding detection apparatus comprises the sheet stopping portion for stopping the sheet being fed and the detection portion for detecting the mutual overlapping of the sheets as to the stopped sheets. The second detection apparatus is characterized by detecting the mutual overlapping of the sheets based on the length of the passing sheet.

According to the configuration, it is possible to detect the overlapped feeding in two stages of detecting the overlapped feeding as to the stopped sheets and detecting the overlapped feeding as to the sheets being fed in the paper path. The second detection apparatus is located further upstream in the feeding direction than the overlapped feeding detection apparatus. The second detection apparatus can detect the overlapped feeding before stopping. For that reason, occurrence of a jam in the paper path can be prevented by detecting the overlapped feeding early, and processing efficiency of the sheet feeding apparatus can be improved.

The overlapped feeding detection apparatus detects the overlapped feeding which could not be detected by the second detection apparatus. Thus, the detection is doubly performed so that the overlapped feeding can be securely detected. In this case, the overlapped feeding detection apparatus includes the flattening portion for, on stopping the sheet being fed, flattening a part of the sheet corresponding to a location detected by the detection portion. Thus, the overlapped feeding detection apparatus can constantly detect whether there is the overlapped feeding in the flat part of the sheet, and so detection accuracy is improved.

The sheet feeding apparatus including the overlapped feeding detection apparatus is provided to a document feeding apparatus or an image processing apparatus. It is thereby possible to securely detect the overlapped feeding, so that the sheets will not be jammed in the paper path.

DETAILED DESCRIPTION OF THE PREFERRED EMBODIMENTS

Figure 1:
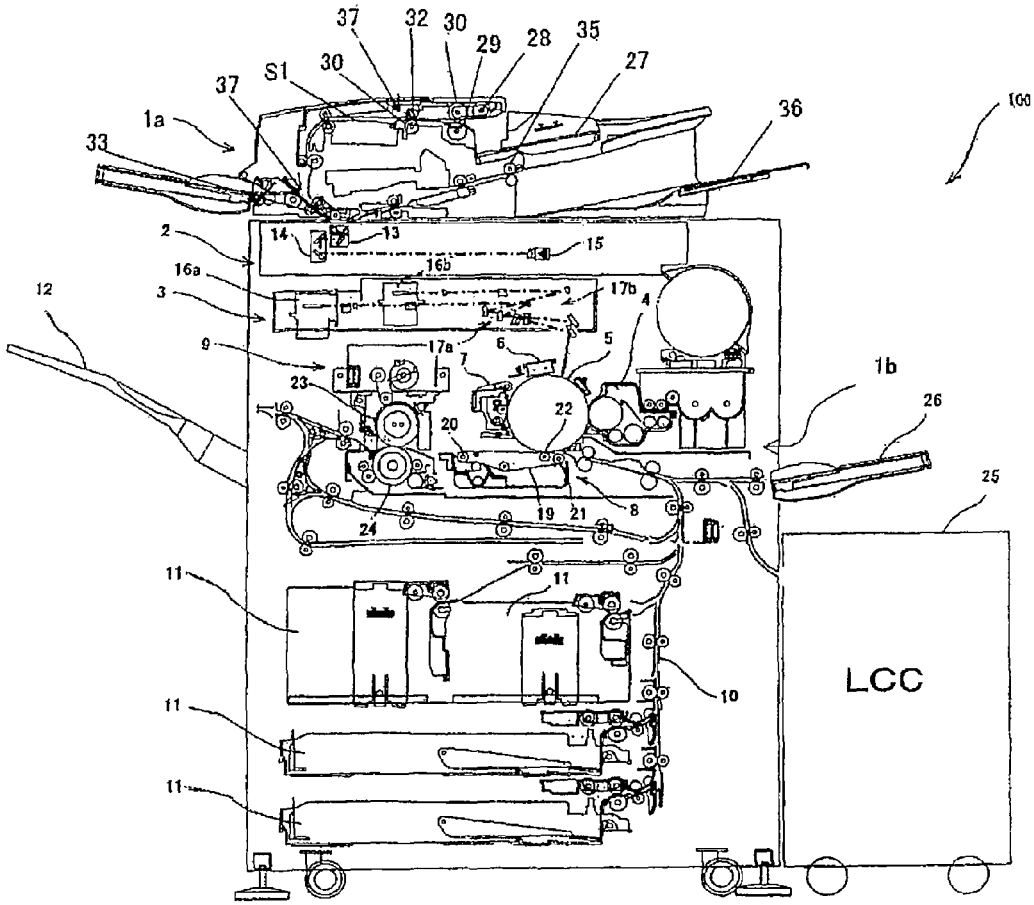
FIG. 1 is an overall configuration diagram of an image processing apparatus according to the present invention.

FIG. 1 shows an image processing apparatus according to this embodiment. An image processing apparatus 100 forms an image in monochrome, in colors or the like on predetermined recording papers fed by a paper feeding apparatus 1*b* according to image data obtained by scanning a document fed by a document feeding apparatus 1*a* which is a sheet feeding apparatus or image data transmitted from outside.

The image processing apparatus 100 includes the document feeding apparatus 1*a*, a paper feeding apparatus 1*b*, an image reading portion 2, an optical writing unit 3, a development apparatus 4, a photoreceptor 5, a charger 6, a cleaner unit 7, a transfer unit 8, a fixing unit 9, a paper path 10 and a document path S1.

Figure 2:
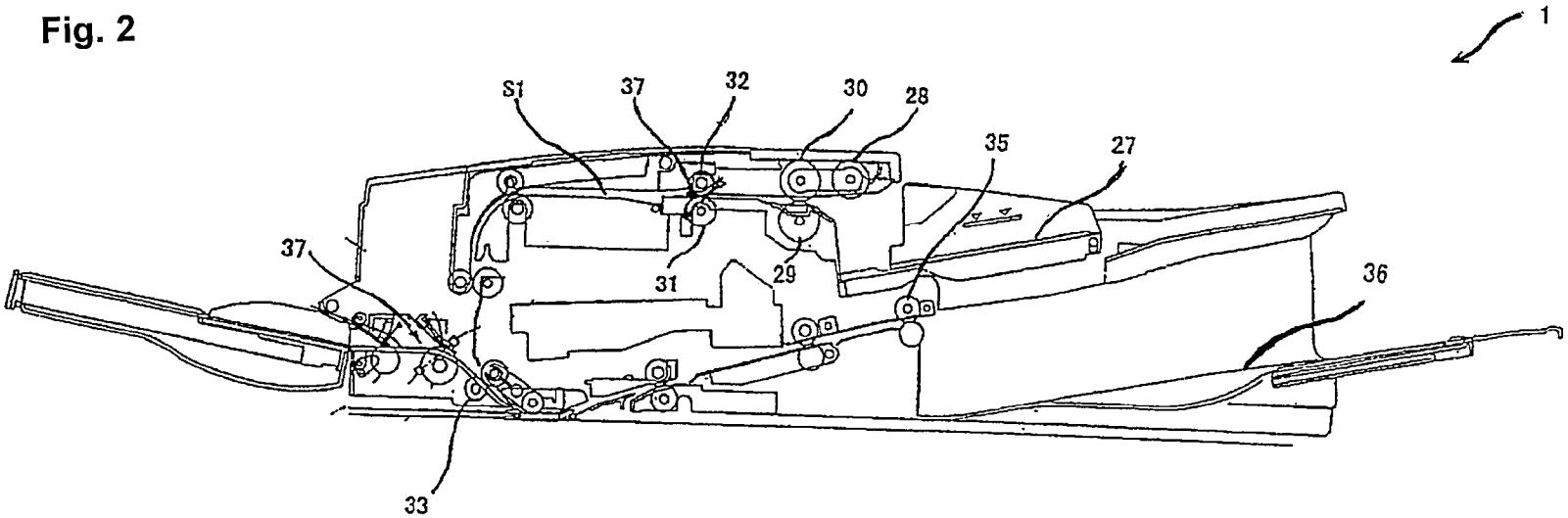
FIG. 2 is a schematic diagram of a document feeding apparatus.

As shown in FIG. 2, the document feeding apparatus 1*a* includes a document tray 27 on which a stack of documents is placed, a pickup roller 28 for feeding a document from the stack of documents to the document path S1, a paper roller 29 and sorting roller 30 for feeding the documents delivered to the document path S1 to a downstream side of the document path S1 while separating them one by one, a pair of feeding rollers 34 composed of a driving roller 31 and a driven roller 32 for feeding the documents along the document path S1, resist rollers 33 for delivering the document to the image reading portion 2 in predetermined timing, and a paper ejection roller 37 for discharging the document having been subjected to image reading to a catch tray 36.

Of the stack of documents placed on the document tray 27, the document feeding apparatus 1*a* delivers a top document by the pickup roller 28 and feeds subsequent documents one by one to the document path S1 by the paper roller 29 and the sorting roller 30 rotating in the same direction. And the document feeding apparatus 1*a* feeds the fed document to the image reading portion 2 through the feeding rollers 34 and the resist rollers 33. Thereafter, the document having been subjected to image reading is discharged to the catch tray 36 by the paper ejection roller 37.

The image reading portion 2 includes a light source holder 13, a mirror group 14 and a CCD 15. In the case of scanning the document sent from the document feeding apparatus 1*a*, the light source holder 13 and the mirror group 14 scan the image of the document in a standstill state. To be more precise, if the document is fed from the document feeding apparatus 1*a*, light is emitted on the document from a light source of the light source holder 13. And the light reflected off the document has its light path converted via the mirror group 14 and is focused on the CCD 15 so as to be converted to electronic image data.

The charger 6 is charging means for evenly charging the surface of the photoreceptor 5 at a predetermined potential. Although this embodiment uses the charger 6 of a charger type, a charger of a contacting roller type or a brush type may also be used.

To handle high-speed printing process, the optical writing unit 3 adopts a two-beam method including two laser irradiation portions 16*a* and 16*b*, where a burden in conjunction with speeding up of irradiation timing is alleviated. A laser beam is emitted from the laser irradiation portions 16*a* and 16*b* according to inputted image data so as to expose the photoreceptor 5 evenly charged by the charger 6 via mirror groups 17*a* and 17*b*. Thus, an electrostatic latent image according to the image data is formed on the surface of the photoreceptor 5.

This embodiment uses a laser scanning unit including the laser irradiation portions 16*a*, 16*b* and the mirror groups 17*a*, 17*b* as the optical writing unit 3. However, it is also possible to use an EL writing head or an LED writing head having light-emitting elements arranged like an array.

The development apparatus 4 placed in proximity to the photoreceptor 5 forms an actual image of the electrostatic latent image formed on the surface of the photoreceptor 5 with a black toner. The cleaner unit 7 placed around the photoreceptor 5 eliminates and collects the toner remaining on the surface of the photoreceptor 5 after the development and image transfer.

The electrostatic image actually formed on the surface of the photoreceptor 5 is transferred on the recording paper by applying to the fed sheet of paper an electric field of a reverse polarity and a charge of the electrostatic image from the transfer unit 8. In the case where the electrostatic image has a charge of negative polarity for instance, the applied polarity of the transfer unit 8 is positive polarity.

A transfer belt 19 of the transfer unit 8 is stretched by a driving roller 20, a driven roller 21 and other rollers, and has a predetermined resistance value ($1\times10^{9}$ to $1\times10^{13}$ Ω·cm). An elastic conductive roller 22 having conductive property and capable of applying a transfer field is placed in a contact portion between the photoreceptor 5 and the transfer belt 19.

The electrostatic image transferred on the recording paper by the transfer unit 8, that is, an unfixed toner is fed to the fixing unit 9 so that the unfixed toner is melted and fixed on the recording paper.

The fixing unit 9 includes a heating roller 23 and a pressure roller 24. In an inner circumferential portion of the heating roller 23, there contains a heat source for keeping the surface of the heating roller 23 at a predetermined temperature (about 160 to 200° C.). The pressure roller 24 has pressure members not shown placed at its both ends so as to contact the heating roller 23 at a predetermined pressure.

Thus, the unfixed toner on the sheet being fed is heated and melted by the heating roller 23, and then fixed on the sheet by the pressure members via the pressure roller 24.

Figure 3:
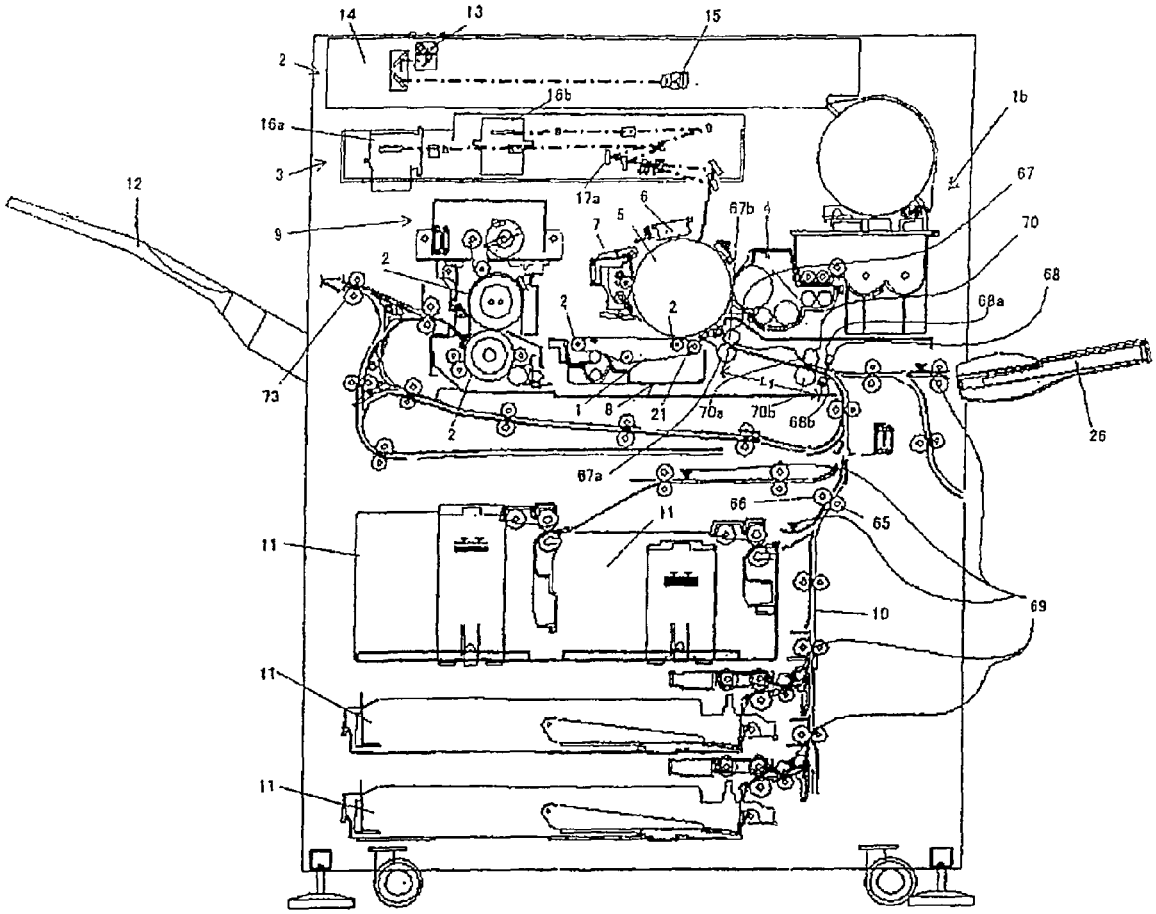
FIG. 3 is a schematic diagram of a paper feeding apparatus.

As shown in FIG. 3, the paper feeding apparatus 1*b* includes a paper feed tray 11 for accumulating the recording paper to be used for image formation, a pickup roller 61 for delivering the recording paper from a stack of the recording paper to the paper path 10, a paper roller 63 and sorting roller 64 for feeding the recording paper delivered to the paper path 10 to the downstream side of the paper path 10 while separating them one by one, a pair of feeding rollers 66*a* composed of a driving roller 65 and a driven roller 66 for feeding the recording paper along the paper path 10, resist rollers 67 for delivering the recording paper to the optical writing unit 3 in predetermined timing, a paper ejection roller 73 for discharging the recording paper having been subjected to image printing process to a catch tray 12, and a passage detection sensor 69 for detecting whether the recording paper fed from the paper feed tray 11 or a manual tray 26 has passed through the paper path 10 in predetermined timing.

The paper feed tray 11 is a tray for accumulating the recording paper to be used for the image formation. Upon a printing request from a user, the paper feed tray 11 is moved upward to put the upper side of the stack of the recording paper in contact with the pickup roller 61. In this embodiment, a plurality of the paper feed trays 11 are provided on the lower side of the image processing apparatus 100.

As an object of this embodiment is the high-speed printing process, each paper feed tray 11 has a secured capacity capable of accommodating 500 to 1500 sheets of standard-size recording paper. The image processing apparatus 100 is provided beside it with a large-capacity paper cassette 25 capable of accommodating large amounts of multiple kinds of the recording paper and the manual tray 26 to be used for printing of a nonstandard size and the like.

The pickup roller 61 is a roller for delivering the recording paper to the paper path 10 from the stack of the recording paper, and is placed above the end on the downstream side in the feeding direction of the paper feed tray 11. The pickup roller 28 delivers to the paper path 10 a sheet of the recording paper in the top position of the stack of the recording paper placed on the paper feed tray 11.

The paper roller 63 is a roller, as a pair with the sorting roller 64, for delivering the recording paper to the paper path 10, which delivers the recording paper fed from the pickup roller 61 to the paper path 10 one by one. To be more precise, the paper roller 63 and the sorting roller 64 are rotated in the same direction by each drive unit such as a motor respectively. The paper roller 63 is positioned on the downside against the sorting roller 64 by sandwiching the paper path 10. It is thereby possible to deliver the overlappingly fed recording paper to the paper path 10 one by one.

The feeding rollers 66*a* are a pair of rollers composed of the driving roller 65 and the driven roller 66, which sequentially feed the recording paper flowing along the paper path 10. A plurality of the feeding rollers 66*a* are provided to the paper path 10.

The driving roller 65 is rotated by each drive unit such as a motor. The driving roller 65 is positioned on the downside against the driven roller 66 by sandwiching the paper path 10. The driven roller 66 is a roller for pressing the fed document against the driving roller 65, which rotates by following rotation of the driving roller 65. There is space for one sheet of the recording paper to pass between the driving roller 65 and the driven roller 66. To be more specific, the fed recording paper is sandwiched by the driving roller 65 and the driven roller 66. Thus, the driving roller 65 can accurately transmit the rotation to the recording paper and feed it without stopping.

The resist rollers 67 are a pair of rollers composed of the driving roller 67*a* rotated by the drive unit such as the motor and the driven roller 67*b* rotated by following the rotation of the driving roller 67*a*. The resist rollers 67 are positioned on the upstream side in the feeding direction against the photoreceptor 5. The resist rollers 67 aligns the ends of the recording paper fed by the feeding rollers 66*a*, and feeds it to the photoreceptor 5 in predetermined timing.

The catch tray 12 is placed on the opposite side to the manual tray 26. A post-processing (stapling, punching or the like) apparatus of ejected paper or a multistage catch tray may also be placed as an option instead of the catch tray 12.

The passage detection sensor 69 is a detection apparatus such as a limit switch or an optical sensor, which detects whether the recording paper flowing through the paper path 10 has passed in predetermined timing. In the case where the passage of the fed recording paper is not detected within predetermined time, the passage detection sensor 69 can determine that the recording paper has jammed in the paper path 10 further on the upstream side in the feeding direction than the passage detection sensor 69. A plurality of the passage detection sensors 69 are provided to the paper path 10.

Figure 4:
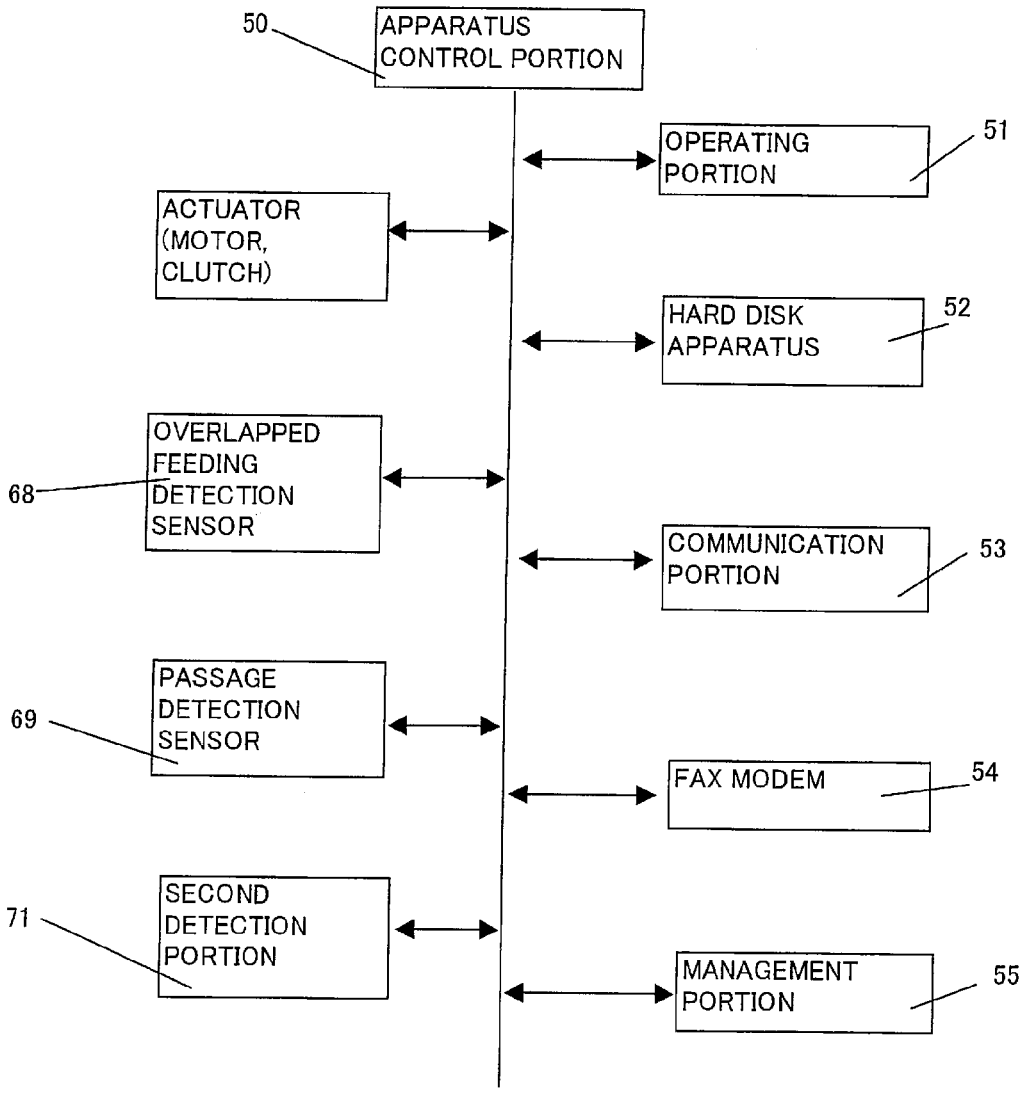
FIG. 4 is a block diagram of a sheet feeding apparatus.

As shown in FIG. 4, the image processing apparatus 100 includes an operating portion 51 for receiving an input of the user, a hard disk drive 52 for storing image data, a communication portion 53 for performing data communication with external apparatuses, a FAX modem 54 for performing communication with a facsimile apparatus, a management portion 55 storing control information and configuration information on the entire apparatus, and a apparatus control portion 50 as a control apparatus composed of a CPU for controlling the entire apparatus.

The operating portion 51 includes an input portion composed of various input keys and a display such as a liquid crystal display. The display is a touch panel, which also functions as the input portion. In the operating portion 51, operating instructions and various settings of the entire apparatus are inputted and input contents and operating conditions of the entire apparatus are displayed. The operating portion 51 receives the input of the operating instructions.

The hard disk drive 52 stores the image data temporarily. An encryption/decryption portion performs an encryption process or a decryption process on the image data. When the image data is stored in the hard disk drive 52, the image data is encrypted by the encryption/decryption portion. When reading out the encrypted image data from the hard disk drive 52, the image data is decrypted.

The communication portion 53 is connected to a router, a switching hub and the like via a LAN cable, and is connected to a network formed by information processing apparatuses such as personal computers and servers. The network is connected to the Internet via a communication line such as a telephone line network or an optical fiber. The communication portion 53 sends and receives the data to and from the information processing apparatuses in the network, and also sends and receives the data and e-mail to and from external information processing apparatuses through the Internet. Furthermore, the communication portion 53 performs Internet facsimile communication with the facsimile apparatus through the Internet. The FAX modem is connected to the telephone line network via a telephone line, and performs facsimile communication with external facsimile apparatuses.

The communication portion 53 and the FAX modem 54 receive and input the image data from the external apparatuses, such as the information processing apparatuses and facsimile apparatuses. To be more specific, they function as image data inputting portion. When inputting the image data from the external apparatuses, the communication portion 53 simultaneously receives the input of the operating instructions so as to also function as an image data input portion Furthermore, the communication portion 53 and the FAX modem 54 perform a process of transmitting the image data to the external apparatuses and thereby function as an image data processing portion.

The apparatus control portion 50 includes a CPU, a ROM for storing a control program executed by the CPU, a RAM for providing a work area to the CPU, a nonvolatile memory for holding control data, an input circuit to which signals from detection means of each portion of the image processing apparatus 100 are inputted, a driver circuit for driving an actuator and the motor which activate a drive mechanism of each portion of the image processing apparatus 100, and an output circuit for driving the laser irradiation portions 16*a* and 16*b*.

Next, the paper feeding apparatus 1*b* will be described in detail based on FIGS. 5 to 7. As mentioned earlier, in the paper feeding apparatus 1*b*, the paper feed tray 11 is moved upward based on a printing instruction from the user, and then the pickup roller 61 feeds the recording paper to the paper path 10 starting from the one positioned at the top of the recording paper stack so as to be fed one by one, by the paper roller 63 and the sorting roller 64, to the downstream side in the feeding direction of the paper path 10.

Under ordinary circumstances, in the case where two or more sheets of the recording paper are overlappingly fed to the paper path 10, the overlapped feeding state is resolved by the sorting roller 30, and the sheets are fed one by one by the paper roller 29 to the downstream side in the feeding direction of the paper path 10 as mentioned above.

However, the paper feeding apparatus 1*b* of this embodiment needs to feed the recording paper at high speed in order to handle high-speed printing process. For that reason, there is a possibility that two or more sheets of the recording paper may be overlappingly fed even if the sorting roller 64 is provided.

Thus, the paper feeding apparatus 1*b* of this embodiment has an overlapped feeding detection sensor 68 provided on the downstream side of the paper roller 63 and the sorting roller 64. The overlapped feeding detection sensor 68 is a sensor for detecting whether or not two or more fed documents are overlapping, which is composed of a wave transmitter 68*a* for transmitting an ultrasonic wave and a wave receiver 68*b* for receiving the ultrasonic wave transmitted from the wave transmitter 68*a*.

The overlapped feeding detection sensor 68 applies the ultrasonic wave transmitted from the wave transmitter 68*a* to the target recording paper. And the ultrasonic wave is received by the wave receiver 68*b* positioned on the opposite side to the wave transmitter 68*a* by sandwiching the recording paper so that it is determined whether there is the overlapped feeding according to a waveform of the received ultrasonic wave. For that reason, it is not possible to correctly detect whether there is the overlapped feeding if the target recording paper is sagged or vibrating and the waveform of the received ultrasonic wave is distorted. Therefore, the overlapped feeding detection sensor 68 needs to detect whether the recording paper is overlappingly fed when the recording paper is not sagged or vibrating, that is, when the recording paper stops.

Figure 5:
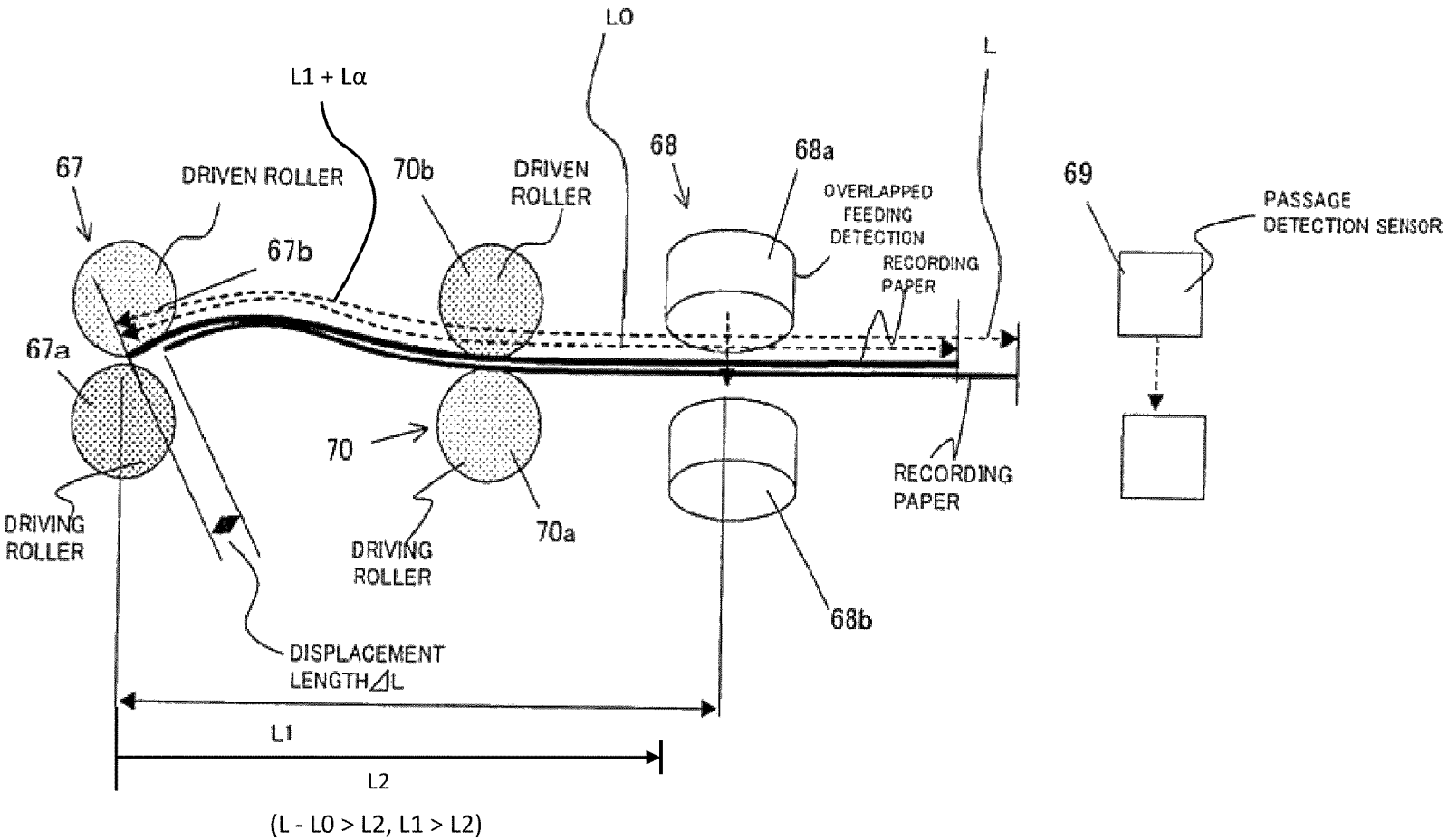
FIG. 5 is an enlarged explanatory diagram of a relevant part of the sheet feeding apparatus, showing the case where displacement length is small.

Thus, as shown in FIG. 5, the overlapped feeding detection sensor 68 is provided on the upstream side in the feeding direction of the resist rollers 67 which once stop the fed recording paper. The overlapped feeding detection sensor 68 is provided in a position where a distance L1 from the resist rollers 67 is smaller than the length of the feedable recording paper. And the overlapped feeding detection sensor 68 is placed in the direction orthogonal to the paper path 10. Thus, the overlapped feeding detection sensor 68 can detect all the recording paper stopped by the resist rollers 67.

The recording paper fed to the resist rollers 67 has its ends aligned. To be more precise, the recording paper becomes inclined in the feeding direction during the feeding. To correct the inclination of the recording paper, the recording paper is pushed from behind by a driving roller 70*a* and a driven roller 70*b* so as to be pressed against the resist rollers 67. For that reason, the recording paper becomes sagged on the whole. Here, the driving roller 70*a* and the driven roller 70*b* become a flattening portion 70 for flattening a part of the sagged recording paper. The overlapped feeding detection sensor 68 is positioned further on the upstream side than the flattening portion 70.

The flattening portion 70 flattens a part of the recording paper, that is, the posterior end of the recording paper further on the upstream side in the feeding direction than the portion sandwiched by the driving roller 70*a* and the driven roller 70*b* of the flattening portion 70. The part detected by the overlapped feeding detection sensor 68 always becomes the flat part of the recording paper. The overlapped feeding detection sensor 68 can constantly detect whether there is the overlapped feeding in the flat part of the recording paper, so that it can accurately detect whether there is the overlapped feeding.

A sheet stopping portion is the resist rollers 67, the flattening portion is the driving roller 70*a* and the driven roller 70*b*, a detection portion is the overlapped feeding detection sensor 68, and an overlapped feeding detection apparatus is composed of the resist rollers 67, the feeding rollers 66*a* and the overlapped feeding detection sensor 68.

The overlapped feeding detection sensor 68 can accurately detect the overlapped feeding of the stopped recording paper. To be more precise, the overlapped feeding detection sensor 68 generates the ultrasonic wave after the flat part of the recording paper stopped by the resist rollers 67 stands still so as to detect whether the recording paper standing still is overlappingly fed.

Figure 6:
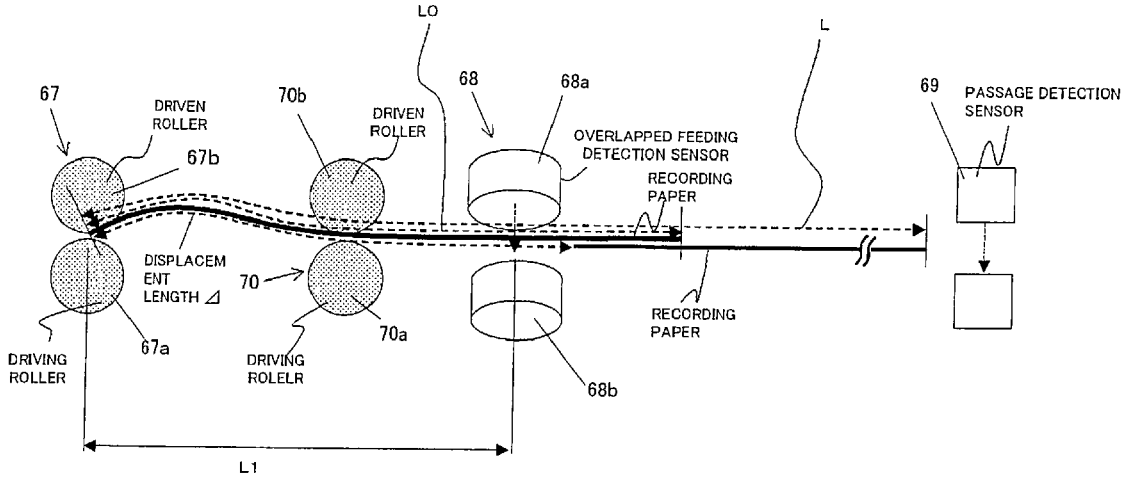
FIG. 6 is an enlarged explanatory diagram of the relevant part of the sheet feeding apparatus, showing the case where displacement length is large.
Figure 7:
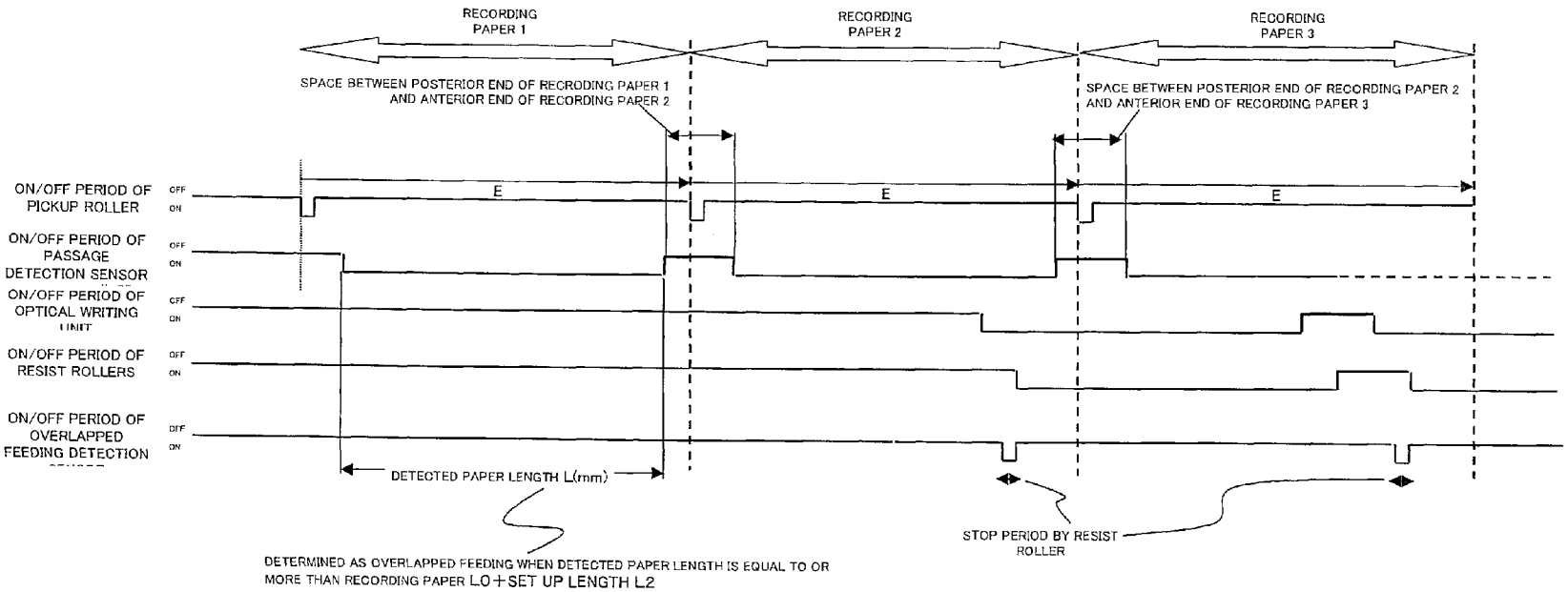
FIG. 7 is a diagram showing driving timing of each individual apparatus.

As shown in FIG. 6, however, there are the very rare cases where the overlapped feeding occurs even though mutual overlapping of the recording paper is little. Of the overlappingly fed recording paper, a displacement length $\Delta L$ between the end of the upper recording paper and the end of the lower recording paper is longer than a distance L1 from the resist rollers 67 to the overlapped feeding detection sensor 68. To be exact, the recording paper is pressed against the resist rollers 67 and then fed a little by the driving roller 70*a* to form a sag. Thus, the recording paper becomes shorter than $\Delta L$ by a sag length $L\alpha$. Therefore, the overlapped feeding detection sensor 68 cannot detect the overlapped feeding of the recording paper in the case of $\Delta L-L\alpha>L1$.

In the configuration, this embodiment includes a second detection apparatus 71 for detecting the overlapped feeding in the case where the displacement length $\Delta L$ is longer than the distance L1. The passage detection sensor placed on the upstream side in the feeding direction of the overlapped feeding detection sensor 68 is utilized as the second detection apparatus 71.

To be more precise, the second detection apparatus 71 detects the overlapped feeding in the case where a length L of the detected recording paper is longer than a length L0 of the recording paper specified by the user or the apparatus control portion 50. The second detection apparatus 71 times time t required for passage of the anterior end to the posterior end of the fed recording paper, and calculates the length L of the recording paper from the timed time t and feeding speed so as to detect the overlapped feeding when the calculation result is longer than the specified length L of the recording paper by an undetectable length L2.

Therefore, the second detection apparatus 71 determines that the recording paper is mutually overlapping when the detected length satisfies $L>L0+L2$. However, by taking the sag length La into consideration, the relation between the distance L1 from the resist rollers 67 to the overlapped feeding detection sensor 68 and the undetectable length L2 is $L1+L\alpha>L2$.

According to the relation, the second detection apparatus 71 can detect the overlapped feeding in the case where the distance displacement length $\Delta L-L\alpha$ is longer than L2, that is, $\Delta L-L\alpha>L2$. In the case where the distance displacement length $\Delta L-L\alpha$ is shorter than the length L2, that is, $\Delta L-L\alpha<L2$, the overlapped feeding detection sensor 68 can detect the overlapped feeding.

However, the sag length $L\alpha$ may not always be the length per design value. For instance, the sag length $L\alpha$ may be shorter than the design value in the case where a surface friction coefficient of the driving roller 70*a* has changed due to variations in components, temporal change because of use and the like. In that case, $L1+L\alpha>L2$ may not be satisfied. Thus, it is possible, by setting it to $L1>L2$, to detect the overlapped feeding and a feeding abnormality of the sheets without fail even if $L\alpha$ becomes shorter than the design value.

In the case where the relation of $L1+L\alpha>L2$ does not hold, that is, in the case where the length L2 is longer than the distance $L1+L\alpha$, the overlapped feeding cannot be detected. For instance, it is the case where the displacement length $\Delta L-L\alpha$ is shorter than the length L2 and longer than the distance L1. In that case, neither the overlapped feeding detection sensor 68 nor the second detection apparatus 71 can detect the overlapped feeding.

The undetectable length L2 is decided from minimum time when the second detection apparatus 71 cannot perform the detection. To be more specific, the undetectable length L2 is decided from the time required for a switching operation of ON-OFF-ON or the time required for the switching operation of OFF-ON-OFF of the second detection apparatus 71.

In the case where the second detection apparatus 71 is a contact type detection sensor, it includes a detection lever (actuator). After the passage of the recording paper, chattering (noise) is generated by mechanical vibration of the detection lever on output change. To eliminate the generated chattering, the second detection apparatus 71 forms the output of the sensor with a waveform of a CR time constant. In that case, the switching operation of the second detection apparatus 71 takes 60 (msec). To be more specific, the minimum time when the second detection apparatus 71 cannot perform the detection is 60 (msec).

To calculate the undetectable length L2, it is necessary to firstly acquire a minimum distance undetectable by the second detection apparatus 71.

$$\text{Minimum distance undetectable} = \text{Paper feeding speed} \times \text{Minimum detection time} \quad (1)$$

Here, the feeding speed of the recording paper of this embodiment is 540 (mm/sec). Therefore, the value is assigned to the formula (1) to calculate the minimum distance undetectable as follows.

Minimum distance undetectable=540 (mm/sec)×60 (msec)=32.4 (mm). The value 32.4 (mm) is the minimum distance undetectable of the second detection apparatus 71. Therefore, in this embodiment, the undetectable length L2 is the value calculated by tripling a value calculated safely enough to allow the second detection apparatus 71 to securely start the detection.

The second detection apparatus 71 is not limited to the passage detection sensor 69 placed in proximity to the upstream side in the feeding direction of the overlapped feeding detection sensor 68. As for the recording paper, detection of a length L0 of the recording paper needs to be completed before arriving at the overlapped feeding detection sensor 68. To be more specific, the recording paper needs to pass the length L wherein the length L0 of the recording paper and the undetectable length L2 are added up or more before arriving at the overlapped feeding detection sensor 68. Thus, the second detection apparatus 71 uses the passage detection sensor 69 placed on the most upstream side in the feeding direction of the overlapped feeding detection sensor 68.

In the case where the second detection apparatus 71 is a noncontact type sensor such as the optical sensor, the undetectable length L2 can be shorter than that in the case of a contact type sensor. It is thereby possible to detect the overlapped feeding of the recording paper being fed earlier and more accurately.

Next, the operation of the paper feeding apparatus 1*b* will be described by using FIG. 7. An ON/OFF period of the optical writing unit 3 indicates timing of image writing to the photoreceptor by the laser emitted by the optical writing unit 3.

Upon the printing instruction from the user or the apparatus control portion 50, in the paper feeding apparatus 1*b*, the paper feed tray 11 accommodating the specified recording paper moves upward, so that the recording paper is delivered to the paper path 10 by the pickup roller 61 starting from the one positioned at the top of the recording paper stack. The delivered recording paper is fed one by one, by the paper roller 63 and the sorting roller 64, to the downstream side in the feeding direction of the paper path 10. The fed recording paper is flowed along the paper path 10 by the feeding rollers 66*a*.

If the recording paper is fed to the resist rollers 67, the rotation of the resist rollers 67 is stopped in order to align the ends of the recording paper, and the fed recording paper is pressed against the resist rollers 67. To be more precise, the ends of the recording paper contact the resist rollers 67 having stopped the rotation, and the recording paper is further pushed to the resist rollers 67 side by the driving roller 70*a* of the flattening portion 70 thereafter. Thus, the recording paper becomes sagged between the resist rollers 67 and the flattening portion 70. The upstream side in the feeding direction from the flattening portion 70 becomes flat.

Here, the timing of detection by the overlapped feeding detection sensor 68 will be described. As for the timing of detection, there are the cases where the ultrasonic wave is constantly generated from the overlapped feeding detection sensor 68 to detect the overlapped feeding from the waveform of the ultrasonic wave received in timing of the stop of the recording paper and the cases where the ultrasonic wave is generated after the stop of the recording paper to detect the overlapped feeding from the waveform of the received ultrasonic wave. In the former case, the wave transmitter 68*a* and the wave receiver 68*b* of the overlapped feeding detection sensor 68 are constantly on. For that reason, it is possible to detect whether there is the overlapped feeding before the recording paper stops. Therefore, the detection of whether there is the overlapped feeding can be performed early. To be more specific, the process as the paper feeding apparatus 1*b* can be performed earlier.

In the latter case, the overlapped feeding detection sensor 68 generates the ultrasonic wave after the recording paper stands still. For that reason, there is no noise due to undulation or sagging of the recording paper in the waveform of the ultrasonic wave received by the wave receiver 68*b*. Therefore, the overlapped feeding detection sensor 68 can accurately detect the overlapped feeding.

As for the wave receiver 68*b* in this case, there are the cases where it is constantly on and the cases where it is simultaneously turned on in timing for generating the ultrasonic wave from the wave transmitter 68*a*. In the case where the wave receiver 68*b* is constantly on, the control becomes easier because only the timing for generating the ultrasonic wave is controlled. In the case where the wave receiver 68*b* is simultaneously turned on in timing for generating the ultrasonic wave from the wave transmitter 68*a*, power consumption can be suppressed in comparison with the case where the wave receiver 68*b* is constantly on.

The overlapped feeding detection sensor 68 detects whether there is the overlapped feeding by applying the ultrasonic wave to the recording paper. The overlapped feeding detection sensor 68 transmits the received ultrasonic waveform signal to the apparatus control portion 50. The apparatus control portion 50 determines whether there is the overlapped feeding by comparing the received waveform signal with the prestored waveform signal. In the case where the apparatus control portion 50 determines that there is the overlapped feeding, it stops the operation of the image processing apparatus 100 and notifies the user of the overlapped feeding. In the case where the apparatus control portion 50 determines that there is no overlapped feeding, it drives the resist rollers 67 and feeds the recording paper to the photoreceptor 5. Thereafter, the image is printed on the recording paper, and the recording paper having the image printed thereon is ejected to the catch tray 12 by the paper ejection roller 73.

The second detection apparatus 71 detects the overlapped feeding of the recording paper that cannot be detected by the overlapped feeding detection sensor 68. The second detection apparatus 71 times the time until the passage of the recording paper. The second detection apparatus 71 transmits the timed transit time to the apparatus control portion 50. The apparatus control portion 50 compares the received transit time with prestored transit time so as to determine whether there is the overlapped feeding. In the case where the apparatus control portion 50 determines that there is the overlapped feeding, it stops the operation of the image processing apparatus 100 and notifies the user of the overlapped feeding. In the case where the apparatus control portion 50 determines that there is no overlapped feeding, the recording paper is fed to the resist rollers 67 without stopping.

The present invention is not limited to the embodiment, but many modifications and changes may be made to the embodiment without departing from the scope of the invention as a matter of course. As the image processing apparatus, it may be a complex machine including a copy mode and a print mode or a dedicated machine of only a single mode such as a copier, a scanner or a printer.

This embodiment describes the case where the overlapped feeding detection apparatus is provided to the paper feeding apparatus. However, it is not limited thereto but may also be adopted to the document feeding apparatus. In the case of providing the overlapped feeding detection apparatus to the document feeding apparatus, the overlapped feeding detection apparatus is provided in proximity to the upstream side in the feeding direction of the resist rollers for feeding the document to the image reading portion. The overlapped feeding detection apparatus may also be provided in proximity to the downstream side in the feeding direction of the pickup roller for delivering the document from the document tray to the paper path. It is thereby possible to detect whether there is the overlapped feeding even before the recording paper is fed to the paper path. To be more specific, the process as the document feeding apparatus can be performed earlier.

The overlapped feeding detection apparatus is provided in proximity to the photoreceptor. However, it may also be provided near the paper cassette, the paper feed tray or the manual tray. In this case, it is possible to detect whether there is the overlapped feeding even before the recording paper is fed to the paper path. To be more specific, the process as the paper feeding apparatus can be performed earlier.

The overlapped feeding detection sensor detects a thickness of the sheet in a vertical direction to the sheet. However, it is not particularly limited thereto but the thickness of the sheet may also be detected in a lateral direction. And the overlapped feeding detection sensor is not limited to an ultrasonic sensor, but may also be the noncontact type sensor such as a camera or a laser or the contact type sensor such as a sensor for detecting the overlapped feeding from a resistance value of the sheet or a sensor for detecting the overlapped feeding from a variation in the actuator. In that case, it is detected whether there is the overlapped feeding after the sheet stops, so that the detection can be performed without being affected by the noise.

Figure 8:
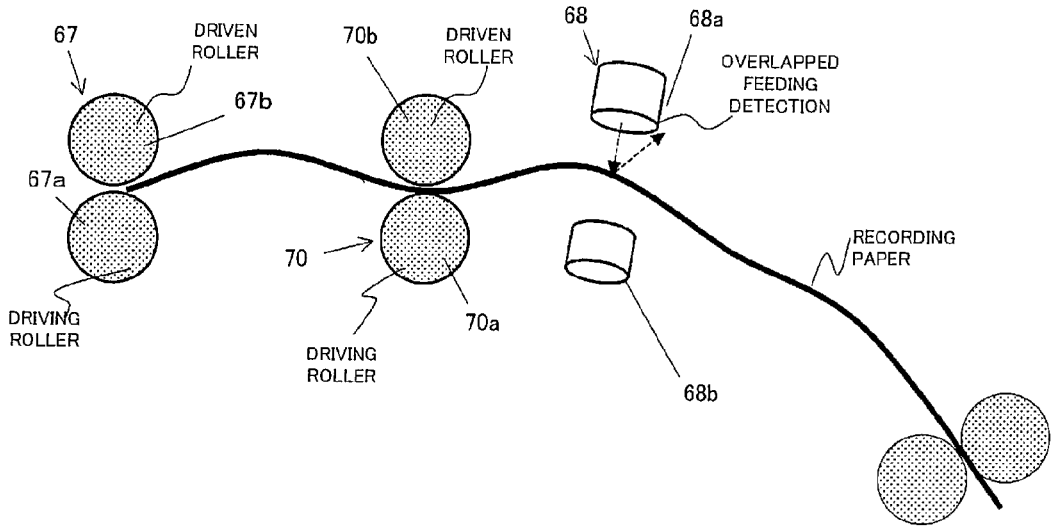
FIG. 8 is an enlarged explanatory diagram of the relevant part of the sheet feeding apparatus, showing the case where an overlapped feeding detection sensor is placed in a position for detecting a sagged portion of a sheet.

As shown in FIG. 8, the overlapped feeding detection sensor may also be placed obliquely against a sagged part generated on the upstream side of the flattening portion on the sheet stopped by the sheet stopping portion. To be more precise, even in the case where the sheet being fed is stopped by the sheet stopping portion, the sheet does not stop at once. For that reason, there are the cases where the sheet becomes sagged on the upstream side of the stopped sheet, that is, further on the upstream side than the flattening portion. The detection portion needs to accurately detect the overlapped feeding as to the generated sag. Thus, the detection portion is placed in the direction orthogonal to the paper path for feeding the sheets and further on the upstream side in the feeding direction than the sheet stopping portion. Furthermore, the detection portion is placed in the position capable of detecting the sagged part when the sheet being fed is stopped by the sheet stopping portion.

According to the configuration, when, in the case of the noncontact type sensor having the detection portion provided with the transmitter and the receiver, an output wave such as the ultrasonic wave or light outputted from the transmitter is reflected on the sheet, the reflected output wave is not reflected on the transmitter side but is horizontally diffused. To be more specific, there is no occurrence of multireflection wherein the outputted output wave is reflected on the sheet surface, reflected again on the transmitter surface, and further reflected on the sheet surface. Thus, it is possible to prevent detection noise due to the multireflection, such as counteracting the output wave by the reflection of the output wave or erroneous reception having the output waves endlessly inputted to the receiver.

The second detection apparatus is not limited to the contact type sensor but may also use the noncontact type sensor such as the optical sensor. In that case, it is possible to reduce undetectable time of the second detection apparatus. For that reason, it is possible to reduce the length set up in order to determine the overlapped feeding. Thus, the overlapped feeding can be detected earlier.

The sheet stopping portion may be in any form for blocking the paper path and stopping the feeding of the sheet, such as a shutter or a projection other than the resist rollers. It is also feasible to stop the sheet by pressing the sheet fed through the paper path on its top face with a press bar, a press roller or the like. However, a wrinkle or a fold should not be generated on the sheet when stopping the sheet. For that reason, the part for stopping the sheet should be provided with a flat plate such as a guide plate or the like under the sheet.

The flattening portion utilizes the feeding rollers. However, it is also possible to flatten the sheet by using the flat plate or a rod-like press member. In that case, a wrinkle or a fold should not be generated on the sheets when stopping the sheet. For that reason, the part for stopping the sheet should be provided with the flat plate such as the guide plate or the like under the sheet.

What is claimed is:

1. A sheet feeding apparatus for feeding sheets one by one, comprising:

an overlapped feeding detection apparatus for detecting mutual overlapping of the sheets being fed; and a control apparatus for controlling the overlapped feeding detection apparatus, wherein the overlapped feeding detection apparatus is provided with:

a sheet stopping portion for temporarily stopping the leading end of a sheet being fed;

a flattening portion sandwiching the sheet temporarily stopped by the sheet stopping portion at an upstream side in the sheet feeding direction and flattening a part of the sheet located at a further upstream side in the sheet feeding direction; and a detection portion for detecting whether or not the sheets are fed in a state of mutual overlapping at the part flattened by the flattening portion, and further wherein the control apparatus controls the sheet stopping portion to stop the sheet being fed when the sheet passes the detection portion, and the detection portion operates after the sheet being fed stops and detects whether or not the stopped sheets are mutually overlapping.

2. The sheet feeding apparatus according to claim 1, wherein a distance from the sheet stopping portion to the detection portion is smaller than a length of a sheet in a minimum size capable of feeding.

3. The sheet feeding apparatus according to claim 1, wherein the sheet stopping portion is resist rollers for aligning ends of the sheet.

4. The sheet feeding apparatus according to claim 1, wherein the flattening portion is feeding rollers for feeding the sheets to the sheet stopping portion.

5. The sheet feeding apparatus according to claim 1, further comprising:

a second detection apparatus for detecting a feeding abnormality based on the length of the sheet during the feeding of the sheet, wherein the second detection apparatus is placed on the upstream side in the sheet feeding direction against the detection portion.

6. The sheet feeding apparatus according to claim 5, wherein the second detection apparatus detects whether or not the sheets are mutually overlapping based on the length of the sheet being fed.

7. The sheet feeding apparatus according to claim 5, wherein:

when the sheet length is $L0$, the second detection apparatus determines that the sheets are mutually overlapping if a length L detected by the second detection apparatus satisfies $L>L0+L2$, provided that $L2$ is $L1>L2$ when the distance from the sheet stopping portion to the detection portion is $L1$.

8. The sheet feeding apparatus according to claim 5, wherein:

when the sheet length is $L0$, the second detection apparatus determines it as the feeding abnormality if a detected length L is $L>L0+L2$, provided that $L2$ is $L1+L\alpha>L2$ when the distance from the sheet stopping portion to the detection portion is $L1$ and a sag length of the sheet being fed is $L\alpha$.

9. The sheet feeding apparatus according to claim 1, wherein the detection portion detects whether or not the sheets are mutually overlapping based on thickness of the sheets being fed.

10. The sheet feeding apparatus according to claim 1, wherein the detection portion includes a wave transmitter for transmitting an ultrasonic wave and a wave receiver for receiving the ultrasonic wave.

11. The sheet feeding apparatus according to claim 1, wherein the detection portion is placed in a direction orthogonal to a paper path for feeding the sheets and further upstream in a feeding direction than the sheet stopping portion.

12. A document feeding apparatus comprising the sheet feeding apparatus according to claim 1.

13. An image processing apparatus comprising the document feeding apparatus according to claim 12.

14. An image processing apparatus comprising the sheet feeding apparatus according to claim 1.

* * * * *